US010577221B2

(12) United States Patent
Sudi et al.

(10) Patent No.: US 10,577,221 B2
(45) Date of Patent: Mar. 3, 2020

(54) IMAGING INSPECTION SYSTEMS AND METHODS FOR ELEVATOR LANDING DOORS

(71) Applicant: Otis Elevator Company, Farmington, CT (US)

(72) Inventors: Sandeep Sudi, Unionville, CT (US); Sally Day Mahoney, New Hartford, CT (US); Frank Higgins, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 383 days.

(21) Appl. No.: 15/593,429

(22) Filed: May 12, 2017

(65) Prior Publication Data

US 2018/0327219 A1 Nov. 15, 2018

(51) Int. Cl.

| | |
|---|---|
| ***B66B 1/34*** | (2006.01) |
| ***B66B 5/00*** | (2006.01) |
| ***B66B 13/30*** | (2006.01) |
| ***B66B 5/02*** | (2006.01) |
| ***B66B 9/00*** | (2006.01) |
| ***B66B 13/00*** | (2006.01) |

(52) U.S. Cl.

CPC ..... *B66B 5/0025* (2013.01); *B66B 5/0018* (2013.01); *B66B 5/02* (2013.01); *B66B 9/00* (2013.01); *B66B 13/00* (2013.01); *B66B 13/30* (2013.01)

(58) Field of Classification Search

CPC ..... B66B 5/0025; B66B 5/0018; B66B 5/02; B66B 9/00; B66B 13/00; B66B 13/30

USPC .... 187/247, 316, 317, 391, 393, 394; 49/26, 49/411, 421, 453, 455

See application file for complete search history.

(56) References Cited

U.S. PATENT DOCUMENTS

| | | | | |
|---|---|---|---|---|
| 4,092,636 A * | 5/1978 | Shepherd, Jr. | ..... | G08B 13/04 250/222.1 |
| 5,135,081 A | 8/1992 | Watt et al. | | |
| 6,435,315 B1 | 8/2002 | Zaharia | | |
| 6,612,403 B2 | 9/2003 | Silberhorn et al. | | |
| 7,165,655 B2 * | 1/2007 | Cook | ..... | B66B 13/26 187/247 |

(Continued)

FOREIGN PATENT DOCUMENTS

| | | |
|---|---|---|
| CN | 201473135 | 5/2010 |
| CN | 103058039 | 4/2013 |

(Continued)

OTHER PUBLICATIONS

European Search Report, European Application No. 18171928.7, dated Oct. 2, 2018, European Patent Office; European Search Report 8 pages.

*Primary Examiner* — Anthony J Salata

(74) *Attorney, Agent, or Firm* — Cantor Colburn LLP

(57) ABSTRACT

Elevator systems and methods for inspection having an elevator car within an elevator shaft are described. A plurality of landing doors are located at respective landings within the elevator shaft and a landing door gib is located on one of the landing doors and subject to inspection. The landing door gib includes an indicator element thereon, and an inspection system is arranged with a detector located on an exterior of the elevator car and arranged to detect the presence of the indicator element in an inspection region.

18 Claims, 7 Drawing Sheets

(56) References Cited

U.S. PATENT DOCUMENTS

| | | | | |
|---|---|---|---|---|
| 7,650,970 | B2 | 1/2010 | Lelic et al. | |
| 8,272,481 | B2 * | 9/2012 | Tracey | B66B 13/301 187/333 |
| 8,556,043 | B2 * | 10/2013 | Mangini | B66B 5/005 187/279 |
| 8,833,524 | B2 * | 9/2014 | De Coi | B66B 13/26 187/316 |
| 8,857,572 | B2 | 10/2014 | Leutenegger et al. | |
| 8,869,449 | B2 * | 10/2014 | El Fassi | E05F 15/40 49/26 |
| 8,960,376 | B2 | 2/2015 | De Coi | |
| 9,352,934 | B1 | 5/2016 | Lee | |
| 9,399,562 | B2 | 7/2016 | Terry et al. | |
| 9,469,501 | B2 | 10/2016 | Lee | |
| 9,975,736 | B2 * | 5/2018 | Anttila | B66B 9/00 |
| 10,011,463 | B2 * | 7/2018 | Kwon | B66B 13/08 |
| 10,196,236 | B2 * | 2/2019 | Sonnenmoser | B66B 5/0018 |
| 2006/0232789 | A1 | 10/2006 | Oh et al. | |
| 2008/0156591 | A1 | 7/2008 | Tracey | |
| 2017/0029246 | A1 * | 2/2017 | Kulak | B66B 13/24 |
| 2018/0327220 | A1 * | 11/2018 | Fauconnet | B66B 13/16 |
| 2018/0327221 | A1 * | 11/2018 | Sudi | B66B 1/3492 |
| 2019/0100412 | A1 * | 4/2019 | Han | B66B 13/26 |
| 2019/0185295 | A1 * | 6/2019 | Noda | B66B 13/26 |
| 2019/0202659 | A1 * | 7/2019 | Sudi | B66B 5/0006 |

FOREIGN PATENT DOCUMENTS

| | | | |
|---|---|---|---|
| CN | 103322930 | | 9/2013 |
| CN | 105173949 | | 12/2015 |
| CN | 106081828 | A | 11/2016 |
| JP | H07101654 | A | 4/1995 |
| JP | H07206341 | | 8/1995 |
| JP | 2010184803 | A | 8/2010 |
| JP | 2010269890 | A * | 12/2010 |
| JP | 2013082542 | A | 5/2013 |
| JP | 5278146 | | 9/2013 |
| JP | 2014076871 | | 5/2014 |
| WO | 2015118064 | | 8/2015 |
| WO | 2016096698 | A1 | 6/2016 |

* cited by examiner

IMAGING INSPECTION SYSTEMS AND METHODS FOR ELEVATOR LANDING DOORS

BACKGROUND

The subject matter disclosed herein generally relates to elevator systems and, more particularly, elevator inspection systems and methods.

Various components and features of elevator systems require inspection, potentially regularly, in order to comply with safety codes and/or specific maintenance routines. Such components and features can include brakes, cables, locks, actuators, etc.

For example, elevator systems have landing door gibs that are arranged to secure landing doors within a track to guide and retain the elevator landing doors when opening and closing. The landing door gibs can also be configured to prevent the landing doors from being pushed inward into the elevator shaft. The landing door gibs may need to be inspected from time to time. It may be advantageous to enable more efficient inspection techniques for landing door gibs of elevator systems.

SUMMARY

According to some embodiments, elevator systems are provided. The elevator systems include an elevator car within an elevator shaft, a plurality of landing doors located at respective landings within the elevator shaft, a landing door gib located on one of the landing doors and subject to inspection, the landing door gib having an indicator element thereon, and an inspection system comprising a detector located on an exterior of the elevator car and arranged to detect the presence of the indicator element in an inspection region.

In addition to one or more of the features described herein, or as an alternative, further embodiments of the elevator systems may include a control unit configured to analyze an output of the detector, determine a state of operation of a landing door gib based on the detection of the indicator element in the inspection region, and generate a notification regarding the state of operation of the landing door gib.

In addition to one or more of the features described herein, or as an alternative, further embodiments of the elevator systems may include that the control unit is located on the exterior of the elevator car and in communication with the detector.

In addition to one or more of the features described herein, or as an alternative, further embodiments of the elevator systems may include that the detector captures images of the indicator element for inspection.

In addition to one or more of the features described herein, or as an alternative, further embodiments of the elevator systems may include that the indicator element is at least one of a colored paint, a textured surface, or a reflective surface.

In addition to one or more of the features described herein, or as an alternative, further embodiments of the elevator systems may include that the detector is located on one of a top or bottom of the elevator car.

In addition to one or more of the features described herein, or as an alternative, further embodiments of the elevator systems may include that the detector comprises at least two cameras arranged to inspect multiple landing door gibs of a landing.

According to some embodiments, methods for inspecting landing door gibs of elevator systems are provided. The methods include moving an elevator car to a landing within an elevator shaft, observing an inspection region using a detector located on an exterior of the elevator car, the inspection region being a region including a landing door gib of the landing, the landing door gib having an indicator element, determining a state of operation of the landing door gib based on the indicator element within the inspection region, and generating a notification regarding the state of operation of the landing door gib based on the determination.

In addition to one or more of the features described herein, or as an alternative, further embodiments of the methods may include analyzing, with a control unit, an output of the detector.

In addition to one or more of the features described herein, or as an alternative, further embodiments of the methods may include that the control unit is located on the exterior of the elevator car and in communication with the detector.

In addition to one or more of the features described herein, or as an alternative, further embodiments of the methods may include capturing images of the indicator element for inspection.

In addition to one or more of the features described herein, or as an alternative, further embodiments of the methods may include that the indicator element is at least one of a colored paint, a textured surface, or a reflective surface.

In addition to one or more of the features described herein, or as an alternative, further embodiments of the methods may include that the detector is located on one of a top or bottom of the elevator car.

In addition to one or more of the features described herein, or as an alternative, further embodiments of the methods may include that the detector comprises at least two cameras arranged to inspect multiple landing door gibs of a landing.

In addition to one or more of the features described herein, or as an alternative, further embodiments of the methods may include moving the elevator car to a second landing within the elevator shaft, observing an inspection region of the second landing using the detector, the inspection region being a region including a landing door gib of the second landing, determining a state of operation of the landing door gib based on the indicator element within the inspection region of the second landing, and generating a notification regarding the state of operation of the landing door gib of the second landing based on the determination.

In addition to one or more of the features described herein, or as an alternative, further embodiments of the methods may include that the method is performed automatically based on a maintenance schedule.

In addition to one or more of the features described herein, or as an alternative, further embodiments of the methods may include receiving an instruction to perform the method from a remote computing device.

In addition to one or more of the features described herein, or as an alternative, further embodiments of the methods may include that the remote computing device is a mobile device.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
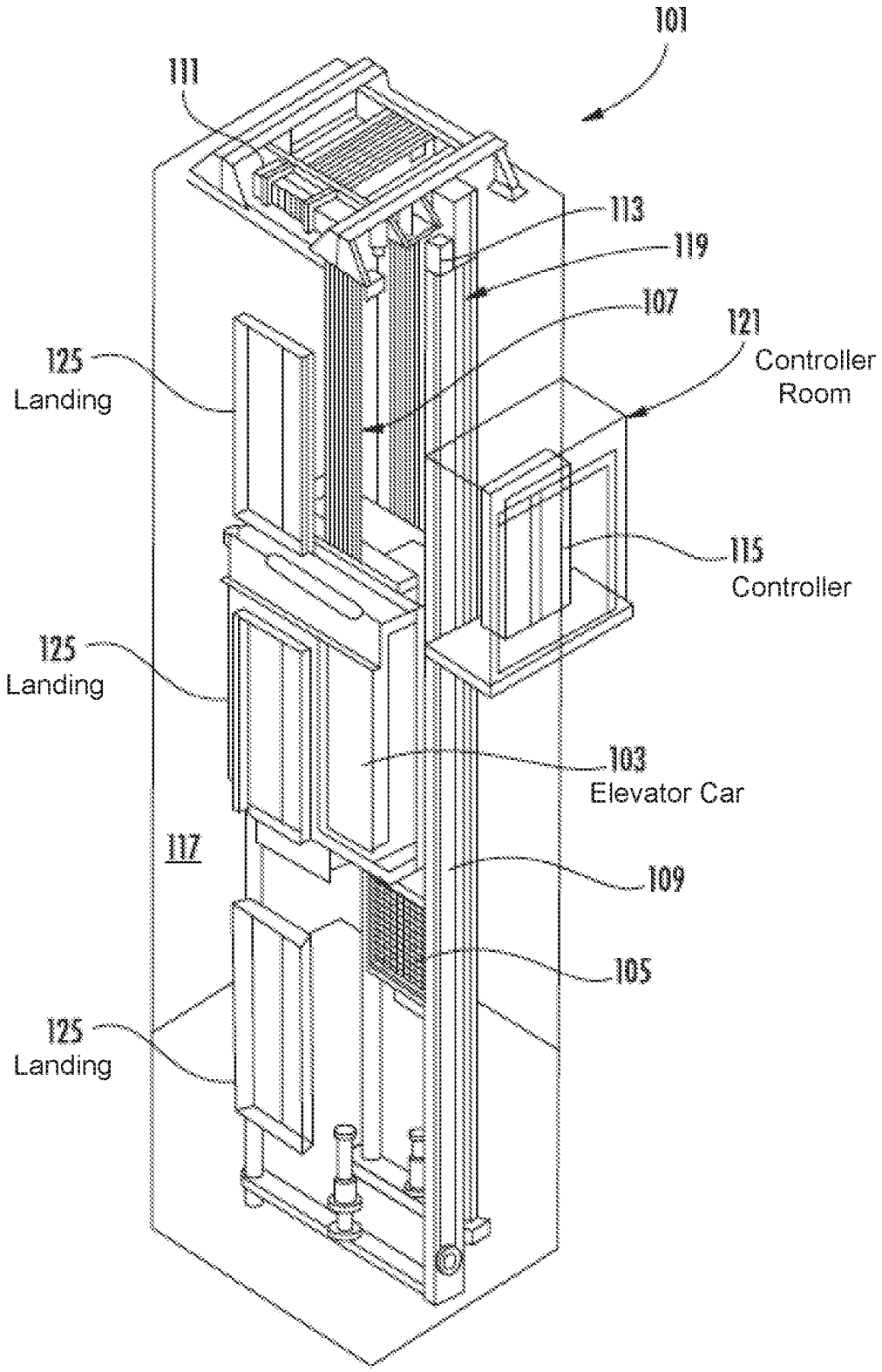
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Elevators are subject to inspection and monitoring to ensure proper operation and safety for users of the elevators and comply with elevator code requirements. However, inspection and monitoring can be time consuming. Accordingly, it may be advantageous to develop systems, devices, and processes to improve the efficiency of inspection and monitoring of various components, features, operations, etc. of elevator systems. For example, in accordance with embodiments of the present disclosure, systems and processes are provided to reduce the time needed to inspect and/or maintain elevators and/or to automatically perform inspections and/or monitoring operations.

One component of note for inspection and ensuring proper operation is landing door gibs. Landing doors are configured to run or slide along a landing door track using landing door gibs, which guide the movement of the landing door, while also providing structural support to prevent the landing door from being pushed into an elevator shaft. Landing door gibs are typically located at the bottom of the landing door and run within a track of a landing door sill of a landing door frame. It is important to verify that the landing door gibs are properly operating and engaging to ensure proper operation and securing of the landing doors. For example, it is important to ensure that the gib is inserted to a sufficient depth within the track. Such inspection, when performed by a technician or mechanic, can be very time consuming and costly. Accordingly, having an automated inspection system for checking landing door lock engagement may be beneficial.

Figure 2A:
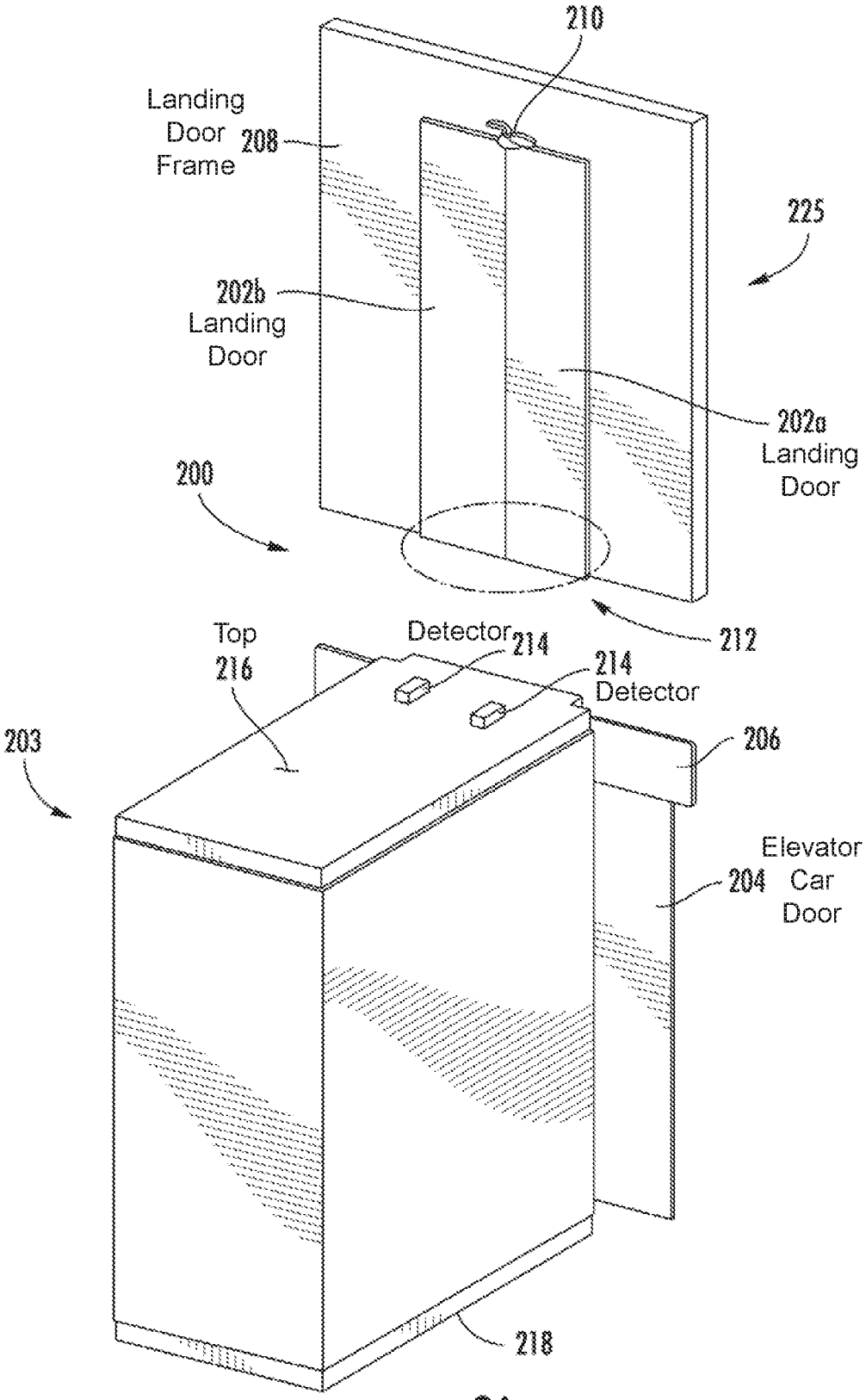
FIG. 2A is a schematic illustration of an elevator car having a landing door gib inspection system in accordance with an embodiment of the present disclosure.
Figure 2B:
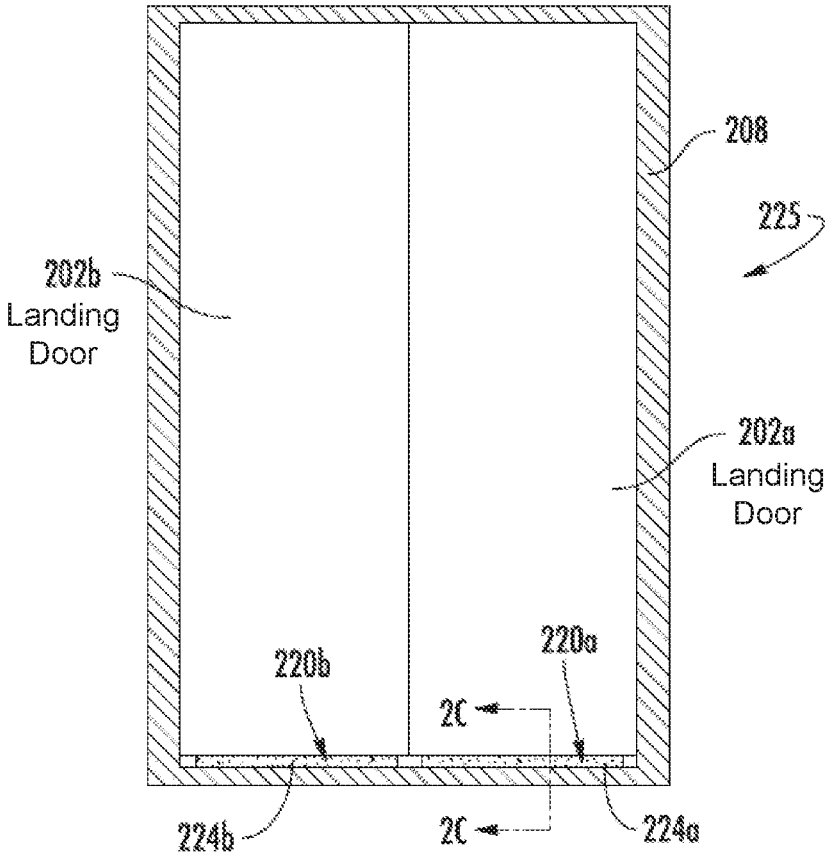
FIG. 2B is plan elevation illustration of the landing door of the elevator system of FIG. 2A.
Figure 2C:
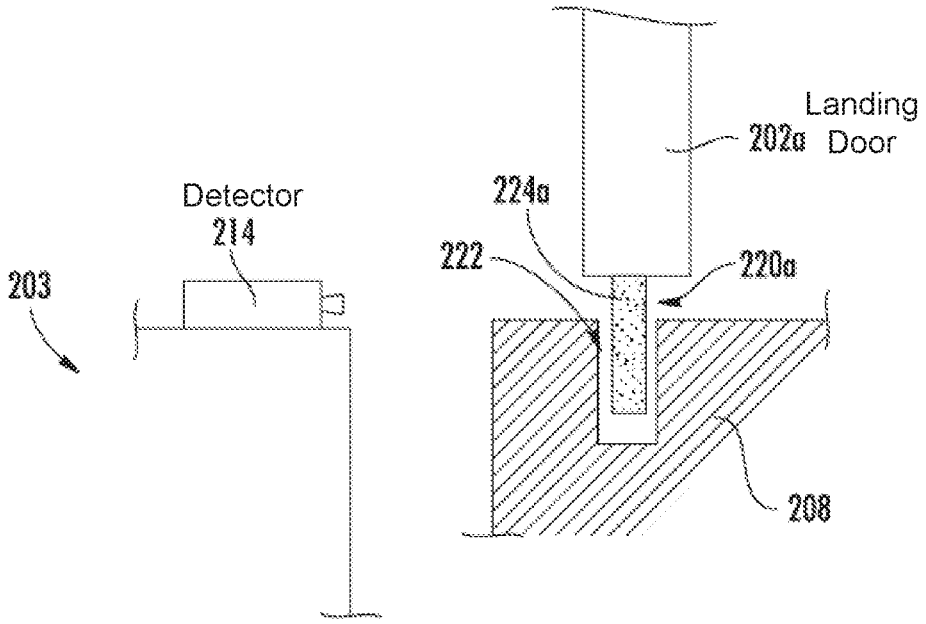
FIG. 2C is an enlarged illustration of the landing door gib inspection system of FIGS. 2A-2B as viewed along the line 2C-2C shown in FIG. 2B.

Turning now to FIGS. 2A-2C, schematic illustrations of a landing door gib inspection system 200 in accordance with an embodiment of the present disclosure are shown. FIG. 2A schematically illustrates an elevator car 203 and a landing 225 having landing doors 202*a*, 202*b*. The elevator car 203 has elevator car doors 204 and a car lintel 206. When the elevator car 203 is located at the landing doors 202*a*, 202*b*, the car lintel 206 aligns with a portion of a landing door frame 208 that includes a landing door lock 210. The landing door frame 208 includes a landing door sill 212 having a track and enables the landing doors 202*a*, 202*b* to open and close within the landing door frame 208, as will be appreciated by those of skill in the art. In operation, a mechanism within the car lintel 206 engages with and unlocks the landing door lock 210 to operate the landing doors 202*a*, 202*b* to open when the elevator car doors 204 open.

To monitor the operation of the landing doors, and particularly engagement of the landing door gib, the landing door gib inspection system 200 includes a detector 214 positioned on a top 216 of the elevator car 203. However, in some embodiments the detector can be positioned on a bottom 218 of the elevator car 203, or located on some other exterior surface of the elevator car 203 and arranged to view a landing door gib. The detector 214 is arranged to detect the operation of the landing door gib within the landing door sill 212 to ensure proper engagement of the elements of the landing door gib (as shown in FIGS. 2B-2C). For example, the detector 214 is arranged to detect the depth at which the landing door gib is inserted into the track on the landing door sill 212. For example, the detector 214 may detect whether the landing door gib is inserted too shallow or too deep into the track on the landing door sill 212. The detector 214 can be a camera or other visual/optical detector that can detect and measure a feature of the landing door gib. In some embodiments, as the elevator car 203 approaches the landing doors 202*a*, 202*b*, the detector 214 can capture one or more images or video of the landing door gib and thus detect the state or operation of the landing door gib, as described herein.

FIG. 2B is a front elevation illustration of the landing 225 of FIG. 2A and FIG. 2C is a cross-sectional illustration of a portion of the landing 225 as viewed along the line 2C-2C shown in FIG. 2B. As shown in FIGS. 2B-2C, the landing doors 202*a*, 202*b* include landing door gibs 220*a*, 220*b*. The landing door gibs 220*a*, 220*b* run or move within a guide track 222 that is formed within the landing door frame 208 (e.g., within a sill or other frame structure), as shown in FIG. 2C.

As the elevator car 203 approaches the landing 225, the detector 214 can capture images and/or video regarding the landing door gibs 220*a*, 220*b*. The images/video can be analyzed to determine if the landing door gibs 220*a*, 220*b* are properly functioning and/or present. To detect the landing door gibs 220*a*, 220*b*, the landing door gibs 220*a*, 220*b* include indicator elements 224*a*, 224*b*, such as a coloring, paint, texturing, surface feature, etc. The indicator elements 224*a*, 224*b* are selected to be detectable by the detector 214. Because of the indicator elements 224*a*, 224*b*, the detector 214 can determine if the landing door gibs 220*a*, 220*b* are present, missing, damaged, etc. Based on an inspection of a detection region, the landing door gib inspection system 200 can generate a notification regarding a state of operation of one or both of the landing door gibs 220*a*, 220*b*. For example, an error notification can be generated if the landing door gibs 220*a*, 220*b* are not as expected based on the indicator elements 224*a*, 224*b* within an inspection region. That is, a calculation or other determination is made with respect to a state of the landing door gibs 220*a*, 220*b*.

Although shown with a specific arrangement, those of skill in the art will appreciate that variations thereon are possible without departing from the scope of the present disclosure. For example, FIGS. 2A-2C illustrate a two detectors 214 (e.g., as shown in FIG. 2A) to observe two landing door landing door gibs 220*a*, 220*b*. However, in alternative embodiments, one or more detectors can be employed to monitor and/or inspect the landing door gibs (e.g., a single detector is shown in FIG. 3).

Figure 3:
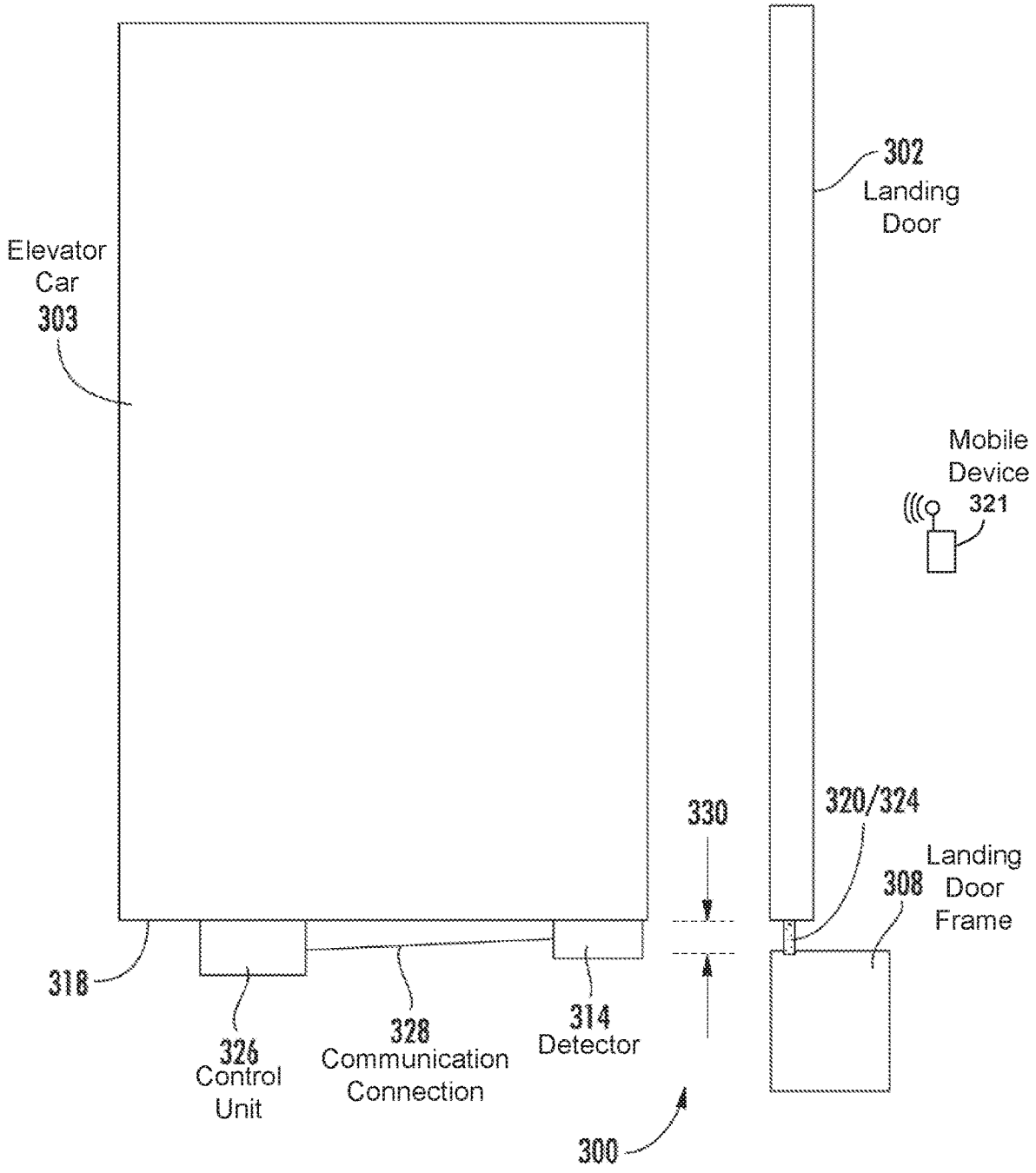
FIG. 3 is a side view illustration of a landing gib inspection system in in accordance with an embodiment of the present disclosure.

Turning now to FIG. 3, a schematic illustration of a landing door gib inspection system 300 in accordance with an embodiment of the present disclosure is shown. FIG. 3 schematically illustrates an elevator car 303 with a portion of the landing door gib inspection system 300 installed on a bottom 318 of the elevator car 303, including a detector 314. The detector 314 is arranged to view a landing door gib 320 that is part of a landing door 302 and runs within a track of a landing door frame 308 at a given landing within an elevator shaft.

The portion of the landing door gib inspection system 300 on the elevator car 303 includes the detector 314, a control unit 326, and a communication connection 328 enabling communication between the detector 314 and the control unit 326. The control unit 326 can be a computer or other electronic device that can send commands to and receive data from the detector 314. In some embodiments, the control unit 326 can receive output from the detector 314 (e.g., images). The communication connection 328 can be a physical line or wire or can be a wireless communication connection, as will be appreciated by those of skill in the art. Further, although shown with the control unit 326 located on the bottom 318 of the elevator car 303, such arrangement is not to be limiting. For example, in some embodiments, the control unit can be part of an elevator controller or other electronics associated with other parts or components of the elevator system. In some embodiments, the control unit may be located remote from the elevator car, on a mechanic tool, smartphone, or in the cloud (e.g., servers, internet-based storage, etc.), and/or in communication with a mobile device or other remote computing device 321. Further, in some embodiments, the control unit may be part of a general purpose computer that is configured to enable maintenance, inspection, and/or monitoring of the elevator system.

The detector 314 is arranged to view the state of the landing door gib 320 by detecting and/or interacting with an indicator element 324 that is part of and/or applied to the landing door gib 320 of the landing door 302. The detector 314 is positioned and calibrated such that the detector 314 can detect the presence of the indicator element on the landing door gib within an inspection region 330. As shown, the inspection region 330 is defined as a space or zone aligned to a portion of the landing door gib 320 that is visible between the landing door 302 and the landing door frame 308. The inspection region 330 is selected to be able to determine if the landing door gib 320 is present within the inspection region 330 or if the landing door gib 320 appears damaged. The control unit 326 (or a portion of the detector 314 depending on electronic configuration) will perform image analysis of the inspection region 330 to determine if the indicator element on the landing door gib 320 or a portion thereof is present within the inspection region 330.

The detector 314 (and/or the control unit 326) is configured to detect and determine the presence and state of the landing door gib 320 by viewing and/or interactive with the indicator element 324 of the landing door gib 320. The indicator element of embodiments of the present disclosure can take various forms. For example, in some embodiments, the indicator element 324 can be a colored paint that has contrast with the color or texture of the landing door 302 and/or landing door frame 308. In such embodiments, the detector 314 can be an optical sensor (e.g., a camera) that is arranged to detect, at least, the presence of the colored paint of the indicator element 324 applied to the landing door gib 320. In other embodiments, the indicator element 324 can be a reflective or refractive surface, texture, or coating that is applied to or part of the landing door gib 320 and the detector 314 can be appropriately configured. For example, with a reflective surface indicator element 324, the detector 314 can include a light source that projects light toward the reflective indicator element 324. The detector 314 further includes, in such arrangements, a sensor that can detect if any light is reflected from the reflective indicator element 324. In some embodiments, the indicator element 324 can be a textured surface or other surface feature of the landing door gib 320 that can be detected by the detector 314. Further still, in some embodiments, the indicator element 324 can be a coding that is applied and detectable by the detector 314 of the landing door gib inspection system 300. Moreover, in some embodiments, the detector 314 and/or the indicator element 324 can be selected to operate at (and/or react to) a specific wavelength or range of wavelengths. Those of skill in the art will appreciate that various other types of detectors and/or indicator elements can be employed without departing from the scope of the present disclosure.

In operation, in one non-limiting example, such as an automated inspection operation, if the indicator element 324 is detected by the detector 314 within the inspection region 330, the control unit 326 will determine that the landing door gib 320 is properly functioning and in compliance with preset conditions and/or requirements. However, if a no portion of the indicator element 324 is detected within the inspection region 330 (or something less than a predetermined threshold detection amount), the control unit 326 will determine that the landing door gib 320 is malfunctioning, is not in compliance with preset conditions or requirements, is damaged, and/or is missing entirely. In such an instance, the control unit 326 can generate a notification or other message that can be used to indicate that maintenance is required on the particular landing door gib 320 (or a notification that the landing door gib is properly operating). In one embodiment, the indicator element 324 may only be applied to a lower portion of the landing door gib 320. In such an embodiment, an error would be indicated any time the indicator element 324 is detected by the detector 314, signaling that the landing door gib 320 is not engaged at an adequate or predetermined depth in the track. Other variations of this detection scheme may also be used.

In other embodiments or arrangements, the inspection/detection may be the opposite of that described above. For example, in some embodiments, the detector can be arranged to generate an error notification based on the presence of the indicator element. That is, in some arrangements, if the landing door jib is damaged or malfunctioning, the indicator element may become visible and thus indicate an error associated with the landing door gib. Thus, the presently described and illustrated embodiments are not intended to be limiting, but are rather provided for illustrative and explanatory purposes.

Figure 4:
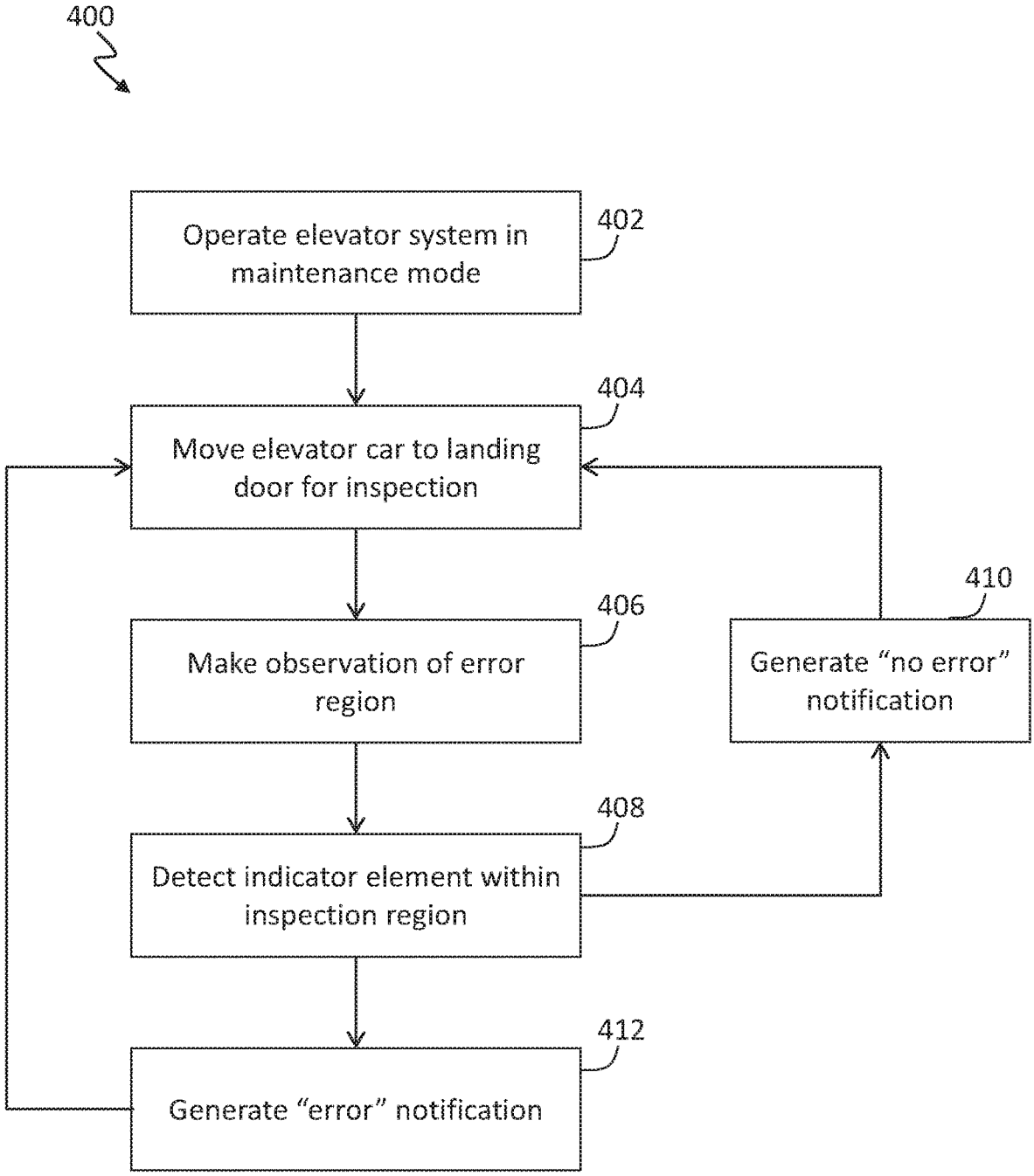
FIG. 4 is a flow process for performing landing door gib inspections in accordance with an embodiment of the present disclosure.

Turning now to FIG. 4, a flow process 400 for performing an automated landing door gib inspection is shown. The landing door gib inspection can be performed using an elevator system as shown and described above, having a control unit, detector, one or more landing door gibs, and an elevator car moveable between landings within an elevator shaft. The landing door gib inspection can be initiated by a mechanic or other person when it is desirable to the status of one or more landing door gib of an elevator system. Such inspection can be performed when an elevator system is first installed within a building and/or may be performed at various times after installation, such as to monitor the landing door gibs on a regular maintenance schedule.

For example, the inspection could be automatically performed in an inspection run of the elevator through the elevator shaft on an hourly basis, daily basis, weekly basis, monthly basis, or at any other predetermined interval. In some embodiments, the inspection may be automatically performed every time the elevator stops at a landing or passes a landing door gib. In some embodiments, the inspection may be automatically triggered by a customer complaint. In some embodiments, the inspection may be triggered remotely (e.g., by a remote computer system) or onsite by a mechanic. In one embodiment, the inspection may be triggered automatically in advance of a scheduled maintenance visit by a mechanic to the elevator installation and the results may be sent automatically to the mechanic in advance or saved in the elevator controller for the mechanic to download.

At block 402, the elevator system can be operated in a maintenance mode of operation. The operation within maintenance mode can be optional and in some embodiments, the flow process 400 (omitting block 402) can be performed during normal operation of the elevator system. In embodiments wherein the maintenance mode is activated, such activation can be manual or automatic. For example, in an example of manual operation, a mechanic or technician can use a control element to run the elevator system in maintenance mode to perform inspection or other maintenance operations while the mechanic or technician is present. In other embodiments of manual operation, a mechanic can trigger the flow process 400 using a mobile device or other remote computing device (e.g., smartphone, tablet, laptop, etc.) to use an application to initiate the flow process 400. In other embodiments, the maintenance mode of operation can be automatically activated, such as through an elevator controller or control unit that is programmed to perform automatic inspection and monitoring of various components of the elevator system.

At block 404, the elevator car is moved to a landing door for inspection. The landing door can be of any landing within an elevator shaft, and may be preselected based on a maintenance routine (e.g., automated and/or programmed) or based on a selection or instruction from a mechanic or technician (e.g., manual selection). The movement of the elevator car can be controlled by a control unit to move within the elevator shaft at a maintenance speed of operation that may be slower than a normal operation speed. Such reduced speed can be beneficial for performing landing door gib inspections in accordance with the present disclosure, although such reduced speeds are not required in all embodiments.

At block 406, a detector is used to observe an inspection region, such as shown and described above. The detector can be an optical detector or other sensor or device that can detect an indicator element of a landing door gib, as shown and described above. The observation can be a picture or snapshot that is taken at a predetermined position to enable proper detection of the indicator element in the inspection region (if present). In some embodiments, the observation can be a video, continuous image capture/detection, and/or a series of image captures or detections. In some embodiments, in addition to pass/fail determination, an image of the landing door gib may be saved and sent to a mechanic, local or remote computing device, remote server, and/or cloud storage and/or computing platform.

At block 408, the detector and/or a control unit will analyze the observation made at block 406 to determine if the indicator element (or a portion thereof) is present in the inspection region. In some embodiments, the analysis may be digital and/or image analysis to determine if an error (e.g., damage) exists with respect to the landing door gib. The analysis can be performed on an output of the detector.

If the indicator element is detected, the flow process 400 can end, can continue to a different landing door (i.e., loop back to block 404), or can proceed to block 410 and generate a "no error" notification. Detection of the indicator element can leaded to detection analysis to determine if the landing door gib is damaged. For example, a bent landing door gib may generate a different detected signal (e.g., less of the indicator element is detected) than an undamaged landing door gib. When an undamaged landing door gib is detected, such "no error" notification can be provided to inform a mechanic or technician that the current landing door gib is in compliance with desired operation and/or can be used for generating an inspection history. As such, if no error is detected, a landing door gib inspection system of the present disclosure can be configured to operate in various predetermined ways, without departing from the scope of the present disclosure.

If, at block 408, it is determined that the indicator element is missing or not in an expected position (e.g., undamaged) within the inspection region, the flow process 400 continues to block 412. At block 412, the control unit (or other component) generates an error notification to indicate that there is an error with the specific landing door gib (e.g., damage, missing, etc.). In some embodiments, if an error message or error notification is generated, the control unit can limit the operation of the elevator system such that a specific elevator speed of travel cannot be exceeded until a "no error" is achieved (e.g., replacement, repair, etc.). In some embodiments, if an error notification is generated, the control unit can command the elevator system to switch to a degraded operation mode or be taken out of service (e.g., based on the severity of the detected error). Further, upon receiving an error notification or indication, a mechanic can perform a maintenance operation to fix and/or replace the specific landing door gib. After completing the maintenance operation, the system can run the flow process 400 again to determine if the maintenance operation corrected the error with the specific landing door gib.

In some embodiments, as schematically shown, the flow process 400 can perform a loop with inspection performed at multiple landings in a single inspection operation. For example, if a weekly maintenance inspection operation is performed, the elevator system can perform flow process 400 to inspect every landing door gib within an elevator shaft. When the system detects an error, such error can be noted (e.g., error notification at block 412), and the flow process 400 continues until all landing door gibs are inspected. At the end of all landing door gibs being inspected, a single report can be generated that aggregates the "error" notifications and "no error" notifications of the flow process 400.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

For example, in another example, the detector can capture images that are transmitted to a display for manual inspection. In such embodiments, a mechanic can initiate an inspection operation, similar to flow process 400, but the flow process does not include blocks 408-412. Instead, captured images are transmitted to a display, either onsite or offsite, for inspection and analysis by a human (mechanic, analyst, etc.) and/or for automated and/or digital (computerized) inspection. When errors (e.g., damaged or missing gibs) are detected, reports can be generated to indicate maintenance is required. In some alternative flow processes in accordance with the present disclosure, at block 408, if the indicator element is detected the process can proceed to block 412 ("error") and if no indicator element is detected the process can proceed to block 410 ("no error").

Figure 5A:
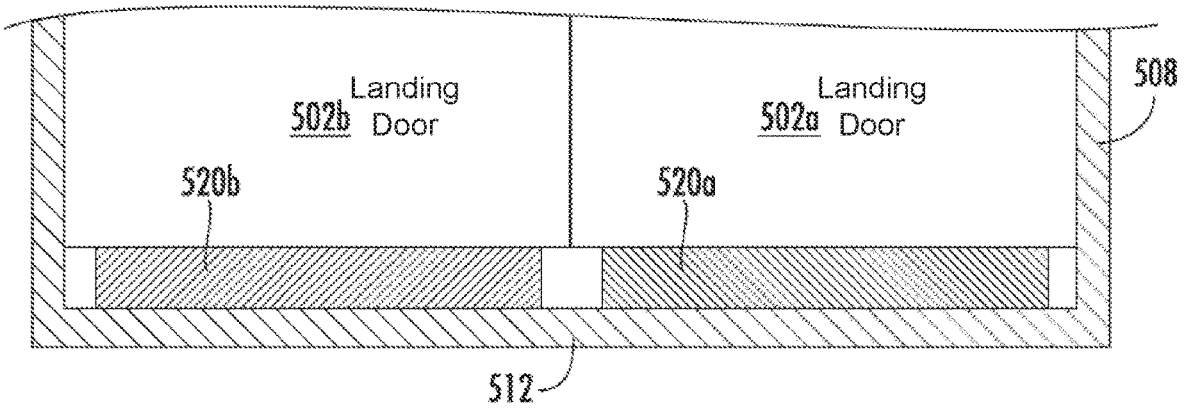
FIG. 5A is a schematic illustration of a landing door in normal operating condition in accordance with an embodiment of the present disclosure.
Figure 5B:
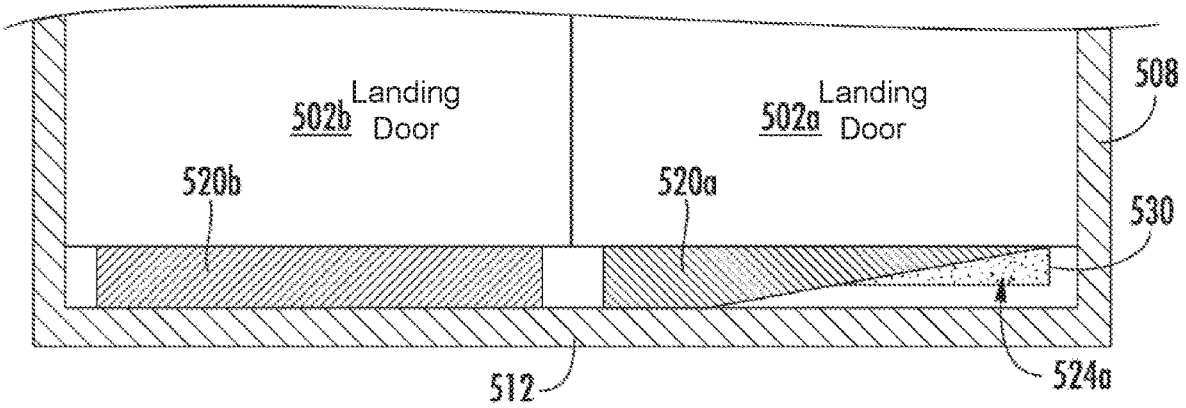
FIG. 5B is a schematic illustration of a landing door with a landing door gib having partial damage in accordance with an embodiment of the present disclosure.
Figure 5C:
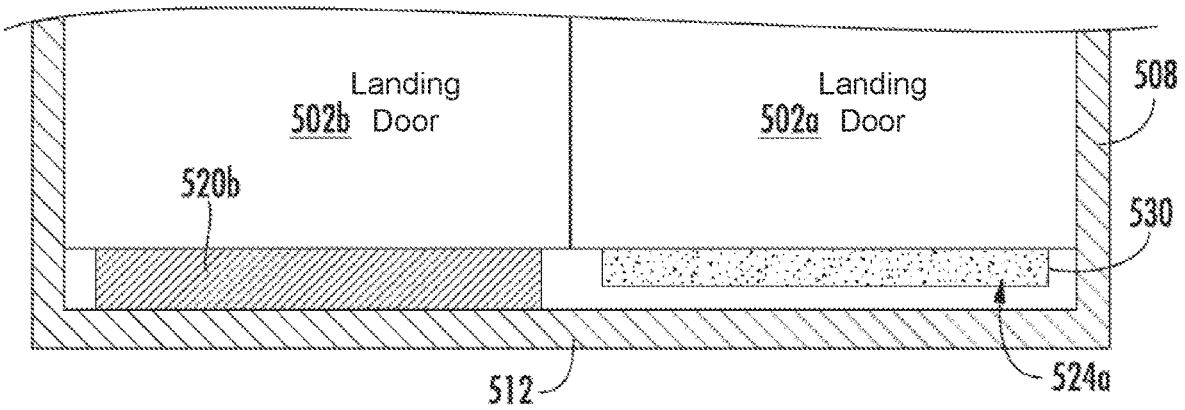
FIG. 5C is a schematic illustration of a landing door having a missing landing door gib in accordance with an embodiment of the present disclosure.

Turning now to FIGS. 5A-5C, schematic illustrations of various states of operation of landing door gibs as viewed by a detector element in accordance with an embodiment of the present disclosure are shown. FIG. 5A schematically illustrates landing doors 502*a*, 502*b* having respective gibs 520*a*, 520*b* that engage with and run in a track of a landing door frame 508. The landing door frame 508 includes a landing door sill 512 having the track and enables the landing doors 502*a*, 502*b* to open and close as the landing door gibs 520*a*, 520*b* run with the track of the door sill 512 (e.g., as shown in FIG. 2C). As described above, to monitor the operation of the landing doors 502*a*, 502*b*, and particularly operation of the landing door gibs 520*a*, 520*b*, a landing door gib inspection system as shown and described above can be employed. A detector positioned on or in an elevator car can make observations to determine operation of the landing door gibs 520*a*, 520*b*.

In the embodiment of FIGS. 5A-5C, the landing door gibs 520*a*, 520*b* are mounted to or otherwise attached to a portion of the landing doors 502*a*, 502*b*, such as a metal extension or bracket 530 of the landing doors 502*a*, 502*b*. In this embodiment, an indicator element (not shown in FIG. 5A) is present beneath the landing door gibs 520*a*, 520*b*. As such, when a detection or inspection is made, in a normal state of operation (e.g., no damage) of the landing door gibs 520*a*, 520*b*, the detector will not detect the presence of the indicator element (or stated another away, the absence of the indicator element is indication of proper operation).

However, as shown in FIG. 5B, a partially damaged landing door gib 520*a* is shown, while the other landing door gib 520*b* is undamaged. As shown in FIG. 5B, a portion of the landing door gib 520*a* is missing, bent, deformed, or otherwise damaged and an indicator element 524*a* becomes visible. That is, by the change in operational state of the landing door gib 520*a*, a portion of the indicator element 524*a* is now detectable by a detector (e.g., as described above), and a notification regarding a damaged or error state of the landing door gib 520*a* can be made by the landing door gib inspection system. The indicator elements 524*a* may be a reflective surface, paint, color, texture, etc. of or on the bracket 530. In one non-limiting example, in operation, the indicator element 524*a* may be a reflective material or surface that becomes exposed with deformation or damage to the landing door gib 520*a*. Thus, when the landing door gib 520*a* is in good working order, a detector would not receive any reflection when inspecting the landing door gib 520*a*.

FIG. 5C illustrates a similar arrangement as that of FIGS. 5A-5B, but one of the landing door gibs is entirely missing. That is, referring to the drawing, the landing door 502*a* on the right of the image is completely missing a landing door gib and the entirety of the indicator element 524*a* on the bracket 530 of the landing door 502*a* is visible to a detector. In contrast, the other landing door gib 520*b* is present and in a good operational state (e.g., no damage, no deformation, etc.).

Figure 6A:
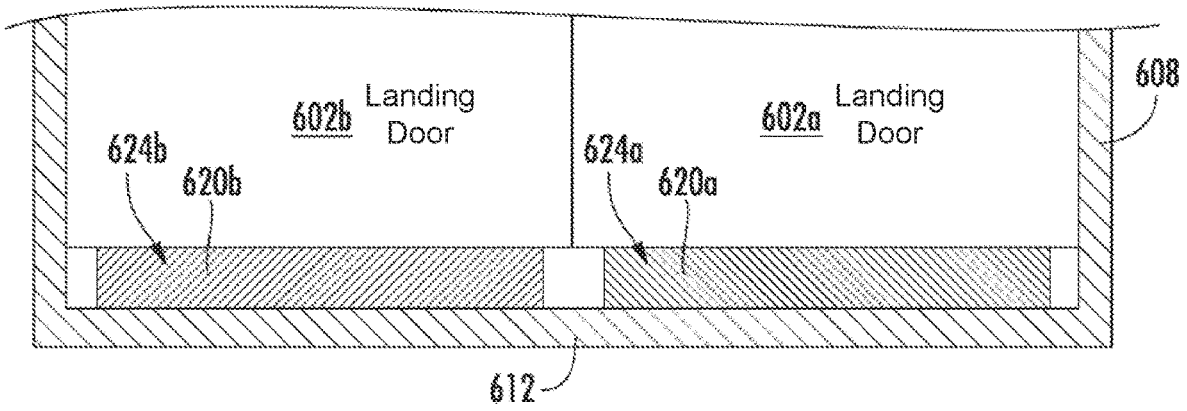
FIG. 6A is a schematic illustration of a landing door in normal operating condition in accordance with an embodiment of the present disclosure.
Figure 6B:
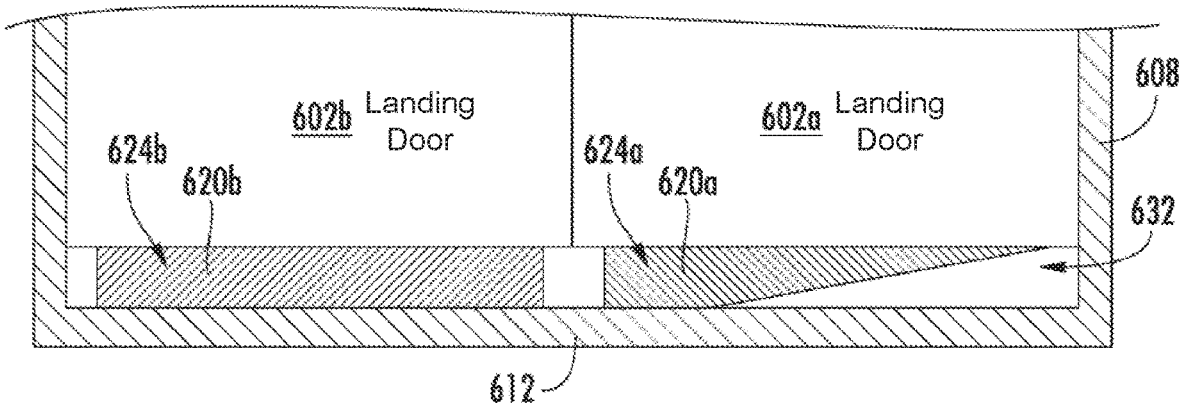
FIG. 6B is a schematic illustration of a landing door with a landing door gib having partial damage in accordance with an embodiment of the present disclosure.
Figure 6C:
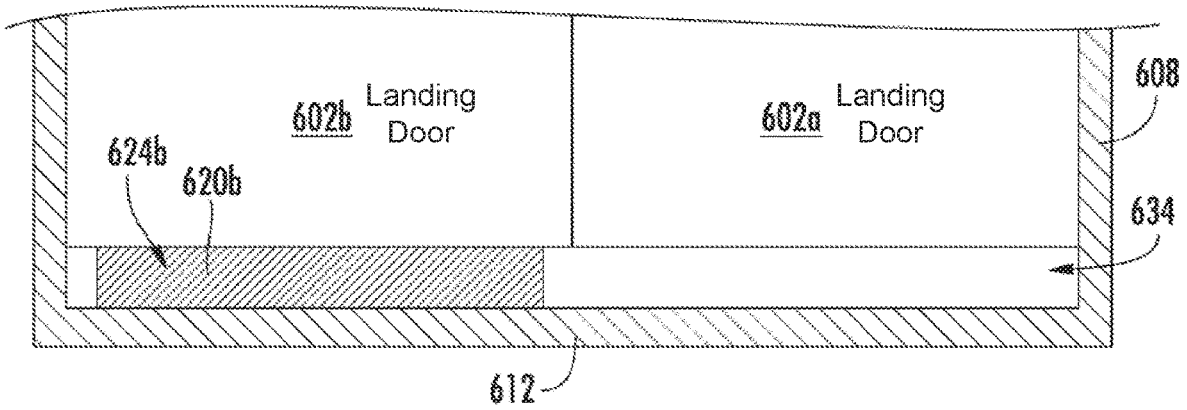
FIG. 6C is a schematic illustration of a landing door having a missing landing door gib in accordance with an embodiment of the present disclosure.

Turning now to FIGS. 6A-6C, schematic illustrations of various states of operation of landing door gibs as viewed by a detector element in accordance with another embodiment of the present disclosure are shown. FIG. 6A schematically illustrates landing doors 602*a*, 602*b* having respective gibs 620*a*, 620*b* that engage with and run in a track of a landing door frame 608. The landing door frame 608 includes a landing door sill 612 having the track and enables the landing doors 602*a*, 602*b* to open and close as the landing door gibs 620*a*, 620*b* run with the track of the door sill 612 (e.g., as shown in FIG. 2C).

In the present non-limiting embodiment, the landing door gibs 620*a*, 620*b* each include respective indicator elements 624*a*, 624*b*. The indicator elements 624*a*, 624*b* may be reflective surfaces, paint, color, texture, etc. As described above, to monitor the operation of the landing doors 602*a*, 602*b*, and particularly operation of the landing door gibs 620*a*, 620*b*, a landing door gib inspection system as shown and described above can be employed. A detector positioned on or in an elevator car can make observations to determine operation of the landing door gibs 620*a*, 620*b* by monitoring for the presence or absence of the indicator elements 624*a*, 624*b*.

In the embodiment of FIGS. 6A-6C, when damage or other operational state errors occur with the landing door dibs 620*a*, 620*b*, such will be reflected or apparent from observation of the indicator elements 624*a*, 624*b*. As such, when a detection or inspection is made, in a normal state of operation (e.g., no damage) of the landing door gibs 620*a*, 620*b*, the detector will detect the presence of the indicator elements 624*a*, 624*b* (or stated another away, the presence of the indicator element is indication of proper operation).

However, as shown in FIG. 6B, a partially damaged landing door gib 620*a* is shown, while the other landing door gib 620*b* is undamaged. As shown in FIG. 5B, a portion of the landing door gib 520*a* is missing, bent, deformed, or otherwise damaged such that a space 632 of an inspection region includes no landing door gib 620*a* or indicator element 624*a* thereon. That is, the change in operational state of the landing door gib 620*a* forms the space 632 and the indicator element 624*a* is now missing within such space 632. Thus a detector (e.g., as described above) will not detect the indicator element 624*a* within the space 632 and a notification regarding a damaged or error state of the landing door gib 620*a* can be made by the landing door gib inspection system. FIG. 6C illustrates a similar arrangement as that of FIGS. 6A-6B, but one of the landing door gibs 620*a* is entirely missing. That is, referring to the drawing, the landing door 602*a* on the right of the image is completely missing a landing door gib and the entirety of the indicator element 624*a* on such landing door gib is missing and not observable by a detector. In such embodiment an empty space 634 is present in the inspection region. In contrast to the right-side, the other landing door gib 620*b* and associated indicator element 624*b* is present and in a good operational state (e.g., no damage, no deformation, etc.) that is detectable by the detector of the landing door gib inspection system.

Advantageously, embodiments described herein provide automated inspection of elevator landing door gibs. The automation can be manually implemented and yet not require a technician to enter an elevator shaft, or can be fully automated as described herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car within an elevator shaft;

a plurality of landing doors located at respective landings within the elevator shaft;

a landing door gib located on one of the landing doors and subject to inspection, the landing door gib having an indicator element thereon; and an inspection system comprising a detector located on an exterior of the elevator car and arranged to detect the presence of the indicator element in an inspection region.

2. The elevator system of claim 1, further comprising a control unit configured to:

analyze an output of the detector;

determine a state of operation of a landing door gib based on the detection of the indicator element in the inspection region; and generate a notification regarding the state of operation of the landing door gib.

3. The elevator system of claim 2, wherein the control unit is located on the exterior of the elevator car and in communication with the detector.

4. The elevator system of claim 1, wherein the detector captures images of the indicator element for inspection.

5. The elevator system of claim 1, wherein the indicator element is at least one of a colored paint, a textured surface, or a reflective surface.

6. The elevator system of claim 1, wherein the detector is located on one of a top or bottom of the elevator car.

7. The elevator system of claim 1, wherein the detector comprises at least two cameras arranged to inspect multiple landing door gibs of a landing.

8. A method for inspecting a landing door gib of an elevator system comprising:

moving an elevator car to a landing within an elevator shaft;

observing an inspection region using a detector located on an exterior of the elevator car, the inspection region being a region including a landing door gib of the landing, the landing door gib having an indicator element;

determining a state of operation of the landing door gib based on the indicator element within the inspection region; and generating a notification regarding the state of operation of the landing door gib based on the determination.

9. The method of claim 8, further comprising analyzing, with a control unit, an output of the detector.

10. The method of claim 9, wherein the control unit is located on the exterior of the elevator car and in communication with the detector.

11. The method of claim 8, further comprising capturing images of the indicator element for inspection.

12. The method of claim 8, wherein the indicator element is at least one of a colored paint, a textured surface, or a reflective surface.

13. The method of claim 8, wherein the detector is located on one of a top or bottom of the elevator car.

14. The method of claim 8, wherein the detector comprises at least two cameras arranged to inspect multiple landing door gibs of a landing.

15. The method of claim 8, further comprising:

moving the elevator car to a second landing within the elevator shaft;

observing an inspection region of the second landing using the detector, the inspection region being a region including a landing door gib of the second landing;

determining a state of operation of the landing door gib based on the indicator element within the inspection region of the second landing; and generating a notification regarding the state of operation of the landing door gib of the second landing based on the determination.

16. The method of claim 8, wherein the method is performed automatically based on a maintenance schedule.

17. The method of claim 8, further comprising receiving an instruction to perform the method from a remote computing device.

18. The method of claim 17, wherein the remote computing device is a mobile device.

* * * * *